US005133235A

United States Patent [19]

DeVito

[11] Patent Number: 5,133,235

[45] Date of Patent: Jul. 28, 1992

[54] SKIP-SCORER SKIP-PERFORATOR FOR USE WITH PRINTING PRESS SYSTEMS

[76] Inventor: Anthony J. DeVito, 19251 Brookhurst, Space 91, Huntington Beach, Calif. 92646

[21] Appl. No.: 637,792

[22] Filed: Jan. 7, 1991

[51] Int. Cl.[5] ..... B26D 3/08; B26D 9/00; B26F 1/08

[52] U.S. Cl. ..... 83/347; 83/332; 83/659; 83/660; 83/678; 83/863; 83/884; 493/367; 493/370; 493/404; 493/471

[58] Field of Search ..... 83/300, 302, 303, 343, 83/346, 347, 660, 673, 674, 675, 676, 678, 695, 863, 884, 332, 864; 493/367, 370, 404, 471; 270/21.1

[56] References Cited

U.S. PATENT DOCUMENTS

| | | | |
|---|---|---|---|
| 1,196,912 | 9/1916 | Weck | 493/396 |
| 1,525,238 | 2/1925 | Hurd | 493/370 X |
| 1,961,896 | 6/1934 | Barrall | 83/300 X |
| 2,735,488 | 2/1956 | Anderson et al. | 83/678 X |
| 3,198,092 | 8/1965 | Koran | 493/397 X |
| 3,522,762 | 8/1970 | Sauer | 83/678 X |
| 3,744,384 | 7/1973 | Jarritt et al. | 493/370 X |
| 4,162,709 | 7/1979 | Wilson | 83/678 X |
| 4,524,962 | 6/1985 | Davenport et al. | 270/21.1 |
| 4,936,818 | 6/1990 | Holohan, Jr. | 493/396 |
| 5,045,045 | 9/1991 | Davenport et al. | 83/660 X |

*Primary Examiner*—Douglas D. Watts
*Assistant Examiner*—Eugenia A. Jones
*Attorney, Agent, or Firm*—G. Donald Weber, Jr.

[57] ABSTRACT

An attachment for use with existing cylinders in printing press equipment. The existing cylinder is machined to have an an annular groove around the center portion thereof. The attachment is mounted in the groove such that a scorer/perforator blade extends beyond the surface of the cylinder.

11 Claims, 1 Drawing Sheet

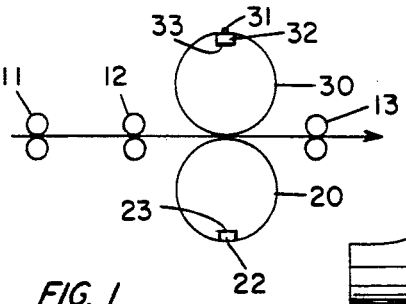
FIG. 1
PRIOR ART
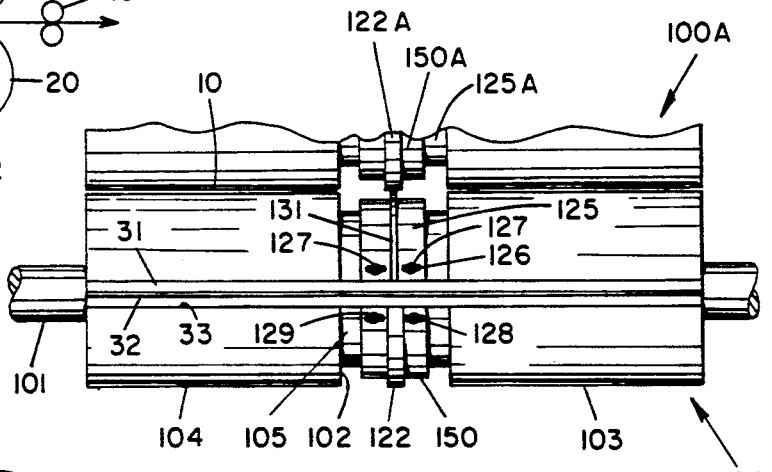
FIG. 2
FIG. 3
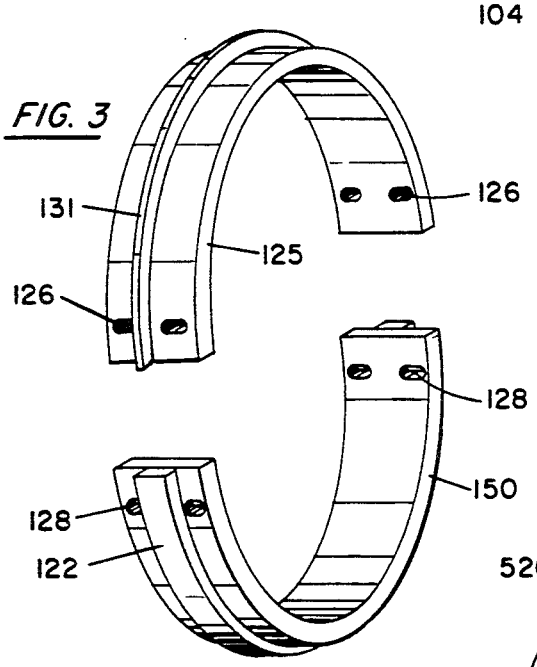
FIG. 4
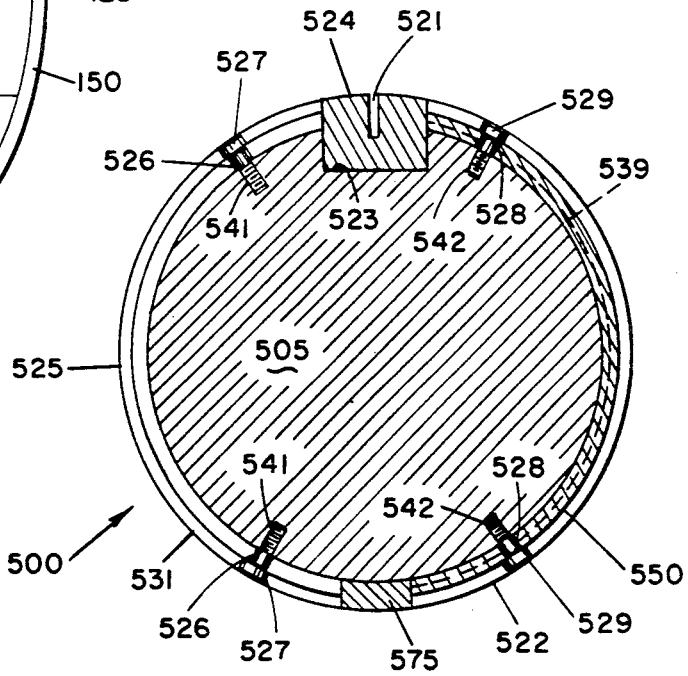
FIG. 5
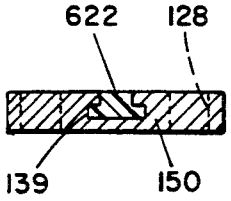
FIG. 6

SKIP-SCORE, SKIP-PERFORATOR FOR USE WITH PRINTING PRESS SYSTEMS

BACKGROUND

1. Field of The Invention

The present invention relates, generally, to the field of printing press systems and, more particularly, to paper perforating and scoring devices directly associated with continuous web printing presses.

2. Prior Art

Expensive, high speed printing presses are commonly used by commercial printing companies. Many such printing presses are fed from large rolls of paper, in a continuous strip known in the art as a "web". The presses are generally known in the industry as web presses and may cost millions of dollars each.

Typically, a web press requires the use of an automated web cutting and folding machine to receive the printed web at high velocity. The cutting and folding machine automatically cuts the web into sheets and folds the sheets into "signatures". The signatures may be sold as produced or they may be delivered to other machines which bind the signatures into books, magazines, or the like. Such signature folding machines are very expensive.

Consequently, it can be appreciated that the presses and folding machines must be capable of operating for extended periods of time at very high speeds in order to be cost effective in the production of finished signatures. However, problems which significantly limit folder and, hence, press speed are commonly associated with the signature folder operation.

One of the significant problems is that many commonly used signature folders are constructed to perform two or more sequential paper folding operations. In a first folding operation, the web is inserted along a fold line between rollers which make the fold and cut the web. The folding problems associated with the first folding stage are no greater than might be expected in high speed folding operations inasmuch as the web is still intact and taut when the first fold is made. However, any subsequent fold is, generally, accomplished by a blade striking the severed sheet along a second fold line and pushing the new fold between a second (and subsequent) pair of rollers. This folding process can be repeated several times.

One way to overcome the problems associated with signature folders is to use two separate signature folders, each of which is operated at half the press speed. Although signature production rates can be substantially increased, equipment and overhead costs are also increased significantly.

Recognizing the above, press and folder manufacturers have attempted to reduce the second stage folding problems by scoring the web along the second fold line before the first fold is made. For such pre-fold scoring, the web passes through a web scoring apparatus in the signature folder upstream of the first folding stage. The scoring apparatus typically includes a circular scoring blade mounted on one side of the web and a resilient roller mounted on the other side of the web. As the web advances between the rotating scoring blade and roller, the blade presses a longitudinal indentation or groove into the web along the subsequent second fold line.

For several reasons, a pre-fold web scoring apparatus for use in signature folders and which scores the web in alternating directions corresponding to the second fold direction for each layer of the paper is desirable. Such a device is referred to as a "skip-scorer" and is described in U.S. Pat. No. 4,524,962.

The skip-scorer of the prior art includes a pre-fold scoring apparatus through which paper is fed prior to being folded into signatures. The scoring means includes first and second rollers each having separate scoring and resilient abutment portions configured for causing prescribed lengths of the paper to be scored in alternating directions thereby to facilitate the folding thereof. The scoring means are mounted in the path of paper travel so as to enable scoring of the paper before the paper enters the first folding stage.

Preferably, the scoring means comprise first and second complementary-shaped scoring rollers, each of which has alternating peripheral scoring blades and resilient roller portions having arc lengths equal to the length of the fold. The first and second scoring rollers are rotatably mounted upstream of the first folding stage and in the path of paper travel. The two scoring rollers are mounted in mutual, peripheral rolling contact so that the scoring blade portion of each contacts the resilient roller portion of the other as the scoring rollers are rotated. Portions of the paper passing between the scoring rollers are thereby scored in one direction and other portions of the paper are scored in the opposite direction so that each layer of paper to be folded in multiple folding stages is scored in the correct folding direction.

To enable proper scoring for different weights of paper, the scoring blade portions of the first and second scoring rollers are constructed so that each comprises a scoring blade having an arcuate scoring edge which bears upon the resilient roller portion. However, this operation tends to cause the resilient portion of the rollers to wear down. When the resilient portions wear down, the scoring does not occur accurately. Thus, it is necessary to replace the resilient portion of the roller. This replacement is time consuming and expensive in that the roller must be removed from the press and a new roller inserted. Replacement of the resilient surface pads on a roller is, generally, not satisfactory wherein the entire unit must be replaced. Consequently, a more economical arrangement for scoring and/or perforating is desirable as described in co-pending application Ser. No. 07/492,721 of H. Davenport et al.

Also, other printing systems produce a score/perforation transverse to the web travel direction. This operation requires precise relation between system speed and paper speed. In the past, the in-line score/perforation operation (as described above) has required a separate workstation which must also be precisely controlled in terms of speed. If the speed relationships are even slightly out of synchronization, the web will tear. The combination of separate workstation and a substantial timing requirement adds significant additional cost to prior art systems.

PRIOR ART STATEMENT

The most pertinent prior art known to Applicants is listed herewith in numerical order with no significance intended to the ordering.

U.S. Pat. No. 1,196,912; ADJUSTABLE CREASING OR SCORING MECHANISM; E. E. Weck. This patent is directed to a self-contained mechanism capable of scoring a paper along parallel lines spaced apart by any distance.

U.S. Pat. No. 1,525,238; SLOTTING AND SCORING DEVICE; N. L. Hurd. This patent is directed to an apparatus for slotting and scoring box-board materials with a pair of slotting blades spaced apart by a prescribed distance.

U.S. Pat. No. 1,839,491; SCORING MECHANISM FOR ENVELOPE MACHINES AND THE LIKE; A. Novick. This patent is directed to a mechanism for scoring envelope blanks preparatory to folding the blanks into a finished envelope.

U.S. Pat. No. 3,198,092; SCORE MOISTENING DEVICE; H. F. Koran. This patent is directed to an attachment for sheet folding systems which moistens the surface of one or more scoring rollers so that the sheets may be moistened in the areas of the scores thereby producing more effective and more accurate folding of the sheets.

U.S. Pat. No. 3,917,254; APPARATUS FOR FOLDING OF A WEB; H. N. Watrous. This patent is directed to an apparatus which includes a pair of cooperating rollers which roll along fold lines of web in order to loosen the bonds in the web transverse to the ultimate fold lines thereby facilitating folding.

U.S. Pat. No. 3,949,654; ASSEMBLY FOR USE IN A MACHINE FOR PROCESSING SHEET OR SIMILAR MATERIAL; H. Stehlin. This patent is directed to an assembly for processing of sheet material wherein a rotatable tool and an opposing part are positionally adjustable to various spacing therebetween and include toothed shafts which operate as feed rollers for feeding sheet material to the apparatus.

U.S. Pat. No. 4,014,535; CONTINUOUS SHEET COLLATING METHOD AND APPARATUS; R. E. Kleid et al. This patent is directed to a continuous sheet collating system.

U.S. Pat. No. 4,046,366; METHOD FOR PRODUCING BOOKS; W. B. McCain, et al. This patent is directed to a method for producing books by juxtaposing webs of printed material obtained from rolls which are cut, folded twice and delivered to a saddle conveyor for trimming.

U.S Pat. No. 4,416,652; UNIT FOR SCORING WEBS OF PAPER IN THE LENGTHWAYS DIRECTION; R. Fischer, et al. This patent is directed to an apparatus which includes a folder blade for producing a lengthways fold relative in a web of paper.

U.S. Pat. No. 4,524,962; PRE-FOLD, WEB SCORING APPARATUS FOR SIGNATURE FOLDING MACHINE; H. D. Davenport et al. This patent is directed to a printing system which includes a scoring means for applying a pre-fold score in alternating directions along a longitudinal line in the paper to be scored.

U.S. Pat. No. 5,045,045; SKIP-SCORER, SKIP-PERFORATING FOR USE WITH PRINTING PRESS SYSTEMS; H. D. Davenport et al. This patent is directed to an improved skip-scorer, skip-perforator apparatus.

SUMMARY OF THE INSTANT INVENTION

According to the present invention, an improved scoring and/or perforating apparatus is provided for a machine through which a web, e.g. paper, is fed. The scoring/perforating apparatus includes first and second roller attachments one of which has a scoring or perforating blade and the other has a resilient abutment portion for engaging the blade. The apparatus can score or perforate dependent upon the blade utilized.

Preferably, the improved scoring apparatus comprises first and second roller attachments wherein the blades and the resilient portions have arc lengths equal to the length of the fold or perforation to be made. The rollers are mounted in the system upstream from the folding stage and in the path of the paper travel.

The two roller attachments are mounted in mutual, peripheral rolling contact so that the scoring/perforating blade portion of one roller attachment contacts the resilient portion of the other roller attachment as the rollers are rotated. Portions of the paper passing between the scoring rollers are thereby scored or perforated.

The resilient roller portion includes a relatively narrow strip or pad of resilient material, such as urethane. This pad can be inserted into and interlockingly engage a slot or groove in the peripheral surface of the roller attachment. The pad is easily moved into and out of the slot for simple replacement.

In particular, the roller attachments are arcuate members which are mounted to an existing cylinder which produces a transverse perforation (or score) in a conventional machine. The existing cylinder is modified by forming a radial groove in the periphery thereof. The roller attachments are mounted within the radial groove. The blade extends beyond the surface of the cylinder to interact with the web. The resilient portion (or anvil) is co-planar with the cylinder surface. The roller attachments are adjustable within the groove to provide variable positioning of the blade means.

This prefold web scoring apparatus is intended to modify existing signature folding machines.

BRIEF DESCRIPTION OF THE DRAWINGS

FIG. 1 is a schematic representation of a portion of a printing press operation and apparatus known in the art.

FIG. 2 is a plan view of a modified version of the perforator blade cylinder shown in FIG. 1.

FIG. 3 shows one embodiment of the scorer/perforator blade of the scorer/perforator for use in the apparatus shown in FIG. 2.

FIG. 4 shows one embodiment of the anvil portion of the scorer/perforator for use in the apparatus shown in FIG. 2.

FIG. 5 is a cross-sectional view of the cylinder shown in FIG. 2.

FIG. 6 is an end view of one embodiment of the anvil portion of the scorer/perforator shown in FIG. 4.

DESCRIPTION OF A PREFERRED EMBODIMENT

Referring now to FIG. 1, there is shown a schematic diagram of a portion of a printing press apparatus known in the prior art. In this apparatus, a web or sheet of paper 10 passes through the apparatus in substantially continuous form. Nip rollers 11, 12 and 13 are shown as representative devices for moving the web 10 through the apparatus. Of course, other means can be used to move the web. Moreover, other workstations can be provided before, after or intermediate the nip rollers shown in FIG. 1. However, the workstations and/or nip rollers are not a part of this invention, per se, and are not described in detail.

More pertinent to the instant invention and the description thereof, are a pair of rotatably mounted rollers or cylinders 20 and 30, respectively, which are adapted to operate on the web 10 as it passes therebetween. In particular, the cylinders 20 and 30 are used to provide a crosswise perforation through the web 10. That is the web 10 receives a perforation transverse to the length thereof in accordance with standard printing or web handling techniques. In particular, cylinder 30 includes a perforator blade 31 which is mounted in a perforator blade holder 32 in a conventional manner. The blade holder 32 is mounted in a suitable slot or groove 33 which extends axially along the outer surface or periphery of cylinder 30. In this instance, the blade 31 includes a plurality of teeth or serrations at the outer edge thereof. The teeth are intended to selectively pierce the paper web 10 to provide perforations therethrough. As will be recognized by those skilled in the art, these perforations can be used for separation purposes, for the purpose of permitting air to be expelled between portions of the web 10 when it is folded in subsequent operations, as well as other purposes.

A companion or complementary cylinder 20 is rotatably mounted adjacent cylinder 30. The cylinder 20 includes a groove 23 into which is placed a perforator anvil 22. Typically, the anvil 22 is fabricated of a relatively rigid but resilient material such as hard rubber or the like. The anvil 22 is arranged to cooperate with the perforator blade 31 as the cylinders 30 and 20 rotate in conjunction with web 10. That is, the blade 31 engages and passes through web 10 when the blade 31 is in alignment (i.e., in contact) with the anvil 22.

The cylinders 20 and 30 are mounted on suitable shafts which are journaled at an appropriate spacing so as to permit the web 10 to pass therethrough while permitting the perforator blade 31 to make perforations in the web 10. The shafts for the cylinders are not shown in the drawing for convenience. Moreover, it should be understood that the dimensions of the cylinders 20 and 30 are arranged to permit the proper interaction between the cylinders and the web so that there is no tearing or any other difficulty involved. For example, the cylinder rotational speed is a direct relation to the web speed.

This apparatus is conventional in the printing press art and is used in several types of equipment. However, it is frequently necessary to perforate and/or score web 10 in the direction of movement of the web, in addition to the perforation transverse to the direction of movement of the web as performed by the equipment as shown in FIG. 1. In the past, this has required the necessity of adding additional operating stages and equipment to the printing press system.

Referring now to FIG. 2 there is shown one embodiment of the instant invention. In FIG. 2, a representative cylinder 100 and a portion of a companion cylinder 100A are shown. A web 10 (for example an elongated strip of paper) passes between the cylinders. For simplicity, only one full cylinder and a portion of the other cylinder are shown. However, components of cylinder 100A bear the same reference numerals as the similar components of cylinder 100 with a suffix A. Cylinders 100 and 100A are, basically, the same as cylinder 20 or 30 shown in FIG. 1. The cylinder 100 includes an axial shaft 101 which is journaled to the printing press apparatus in the same fashion as cylinders 20 or 30. In this instance, however, the cylinder 100 has been machined or otherwise operated upon to produce an indented groove 102 therearound. The indented groove is arranged to completely circumscribe the cylinder 100, preferrably at about the mid-point thereof. Thus, the cylinder 100 incorporates three sections. In particular, the end sections 103 and 104 are substantially unchanged portions of cylinder 100 while the central portion 105 is a mid-portion of the cylinder with a reduced outer diameter.

A blade holder 32 and perforating blade 31 are also shown in FIG. 2. These components extend axially along the surface of cylinder 100 in groove 33 similar to the embodiment shown and described relative to FIG. 1. Of course, it must be understood that it is equally applicable if the blade anvil 22 were shown in FIG. 2.

Also attached to the mid-portion of 105 of cylinder 100 are a pair of support structures 125 and 150, respectively. The support structures are generally semi-circular in configuration and are arranged to closely conform to the outer surface of section 105 of cylinder 100. Thus, only one end of each of the structures 125 and 150 is shown. Support 125 is adapted to support a blade 131 thereon. Blade 131 can be formed of hardened steel and attached to support 125 in any suitable fashion. Alternatively, support 125 can be made somewhat thicker than desired and machined to permit the blade 131 to be formed integrally therewith. The blade 131 is arranged to project slightly beyond the surface of support 125 and be substantially flush with the outer surfaces of portions 103 and 104 of cylinder 100 (see FIG. 5). Thus, the blade can interact with the web 10 which passes thereby.

A plurality of elongated holes 126 are drilled through the support 125. Appropriate bolts 127 are passed through the apertures 126 into threaded apertures (see FIG. 5)in the surface of section 105 of cylinder 100. Thus, the support 125 is mounted to the cylinder by means of the bolts 127.

By making the holes 126 somewhat elongated in shape, an appropriate adjustment of the support 125 and the blade 131 can be effected. That is, the support 125 can be adjusted axially along the cylinder 100 by sliding the elongated apertures 126 relative to the associated bolts 127. Alternatively, a plurality of threaded apertures can be provided in the surface of portion 105 of cylinder 102. However, this is somewhat more limitative in terms of adjustability. For maximum adjustment capabilities, a plurality of threaded apertures can be provided in section 105 of cylinder 100 and the elongated apertures 126 can be used in the support 125.

A complementary support 150 is constructed in a similar fashion to the support 125. In addition, an anvil supported by support 125 and mounted a pad of relatively rigid but resilient material, such as hard rubber, polyurethane or the like, can be affixed to the outer surface of the support 150. The pad is also dimensioned to be substantially flush with the outer surface of sections 103 and 104 of cylinder 100 (see FIG. 5). In this instance, the anvil is not intended to interact with the web 10 which passes adjacent to the cylinder 100.

It is, of course, understood that a pair of cylinders substantially identical to cylinder 100 shown in FIG. 2 are used in conjunction with each other. The pair of cylinders 100 and 100A operate as suggested in FIG. 1 with a web 10 passing therebetween. Again the perforator blade (and the counterpart anvil) interact to provide the transverse perforation through the web 10.

Similarly, blade 131, 122, for example, in the form of cylinder 100 interacts with the counterpart anvil 122A, supported on support 150A and mounted on the adjacent cylinder 100A (partially shown in FIG. 2) to form either a scored line or a perforated line in the lengthwise direction of the web 10. Inasmuch as the counterpart cylinder 100A has a similar configuration to cylinder 100, an alternating scoring arrangment can be produced along the length of the web, typically at the center line thereof. Of course, the counterpart cylinder 100A may have two anvil supports 150A placed thereon wherein a skip-scoring operation can be achieved with a single blade 131 on cylinder 100. Also, it is possible that two blade support devices 125 can be mounted to one cylinder while two anvil support devices 150 can be mounted to the other (counterpart) cylinder to provide a continuous scoring. These types of arrangments are relatively unlikely but can be accomplished.

Referring now to FIG. 3, there is shown a perspective view of the arcuate support 125 with a scoring blade 131 attached thereto. The support 125 is, typically, formed of metal or other strong, rigid material. As noted the blade 131 may be integrally formed with support 125 through a milling or machining operation or the like. Alternatively, blade 131 can be mounted to support 125 in any suitable fashion. A plurality of elongated holes 126 passes through the support 125 for the reasons noted above.

Referring now to FIG. 4, there is shown a perspective view of the arcuate support 150 which can be formed in the same fashion as support 125. The anvil 122 of hard rubber or the like is affixed to support 150 in any suitable fashion. Again, elongated holes 128 are provided through support 150 for mounting to the center portion 105 of cylinder 100, as described above.

Referring now to FIG. 5, there is shown a cross-sectional view of a representative cylinder 500 in accordance with the instant invention. The cylinder 500 is similar to the cylinder 100 (or the counterpart thereto) shown in FIG. 2. In particular, the cylinder 500 shown in FIG. 5 is arranged to include the transverse perforator anvil 524 (similar to the anvil 24 in FIG. 1). The perforator anvil 524 is mounted in the appropriate slot 523. In this instance, a slot 521 is formed along the length of anvil 524. The slot 521 is adapted to cooperate with the perforator (or scorer) blade on the counterpart cylinder (not shown but similar to blade 31 on support 32). Of course, the slot 521 need not be utilized and the perforator blade may merely engage and cooperate with the anvil 524. This construction is conventional and is shown in FIG. 1. This construction is conventional and is shown generally shown in FIG. 1.

The in-line scorer (or perforator) blade 531 is shown mounted to (or formed with) the support 525. The support 525 includes the apertures 526 therethrough. Appropriate bolts 527 are passed through the holes 526 and engage the threaded holes 541 in cylinder section 505 which corresponds to cylinder section 105 shown in FIG. 2. Thus, the support 525 is securely mounted or anchored to cylinder 505 by means of the bolts 527. The blade 531 ma be provided at the outer surface of a multilevel support apparatus 525, if so desired.

Similarly, the anvil holder 550 is mounted to cylinder section 505 by means of the bolts 529 which pass through the elongated openings 528 and engage threaded openings 542 in cylinder section 505. A suitable anvil 522 fabricated of urethane, hard rubber or the like is mounted on the support holder 550 with any suitable means including adhesives or the like. The support 550 may be a multilevel unit including a ledge or slot 539 (shown in dashed line) into which the anvil 522 is mounted. Obviously, the anvil portion 522 may be mounted directly to support 550 wherein a thicker anvil pad may be required.

Typically, the cylinders may include a plurality of axially extending, peripheral slots (such as slots 23 and 33 in FIG. 1) into which the transverse perforator anvil and/or perforator blade are normally placed. However, in some instances the perforator/scorer blade may be omitted if no perforation or score is required. In this instance, a block 575 (which is the same as blade holder 532 except without a blade) may be included in one of the slots in order to provide a suitable surface continuity for the cylinder. By utilizing block 575, the supports 525 and 550 can be made uniform where they are universally mounted to the cylinder 505. Alternatively, the supports 525 and 550 could be made somewhat longer at one end for application to the cylinder.

Referring now to FIG. 6, there is shown an alternative arrangement for mounting the anvil 122 to the support 150. In this instance, the anvil includes an inverted T-shaped portion 622. Likewise, support 150 includes an inverted T-shaped slot 139. The anvil portion 622 is mounted in slot 139. This arrangement permits easy removal and replacement of the anvil 22 to the support 150.

Thus, there is shown and suggested a unique in-line skip-scorer, skip perforator apparatus for use with certain printing press devices. In this instance, the cylinders in the existing equipment are modified to receive additional blades and anvils therein. However, the system does not require any additional workstations or the like.

The particular configuration shown and described herein relates to a printing press apparatus with transverse perforating capabilities in particular. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. An apparatus for use with printing press equipment comprising, a cylinder having a radius of curvature, said cylinder including a groove which encircles said cylinder and is defined by a reduced diameter portion of said cylinder, elongated perforation means mounted at the surface of said cylinder and extending axially along the length of said cylinder, said elongated perforation means arranged to span said groove, first and second arcuate support means adapted to be mounted to said cylinder in said groove, said first arcuate support means including arcuate blade means having a working edge extending therefrom, said second arcuate support means including arcuate anvil means mounted thereto, said arcuate blade means and said arcuate anvil means having substantially the same radius of curvature as said cylinder, said first and second arcuate support means mounted in end-to-end relationship in said groove with said elongated perforation means interposed between ends of said first and second arcuate support means such that said first and second arcuate support means abut against said elongated perforation means.

2. The apparatus recited in claim 1 wherein,
said working edge is a relatively thin, smooth edge.

3. The apparatus recited in claim 1 wherein,
said working edge is a relatively thin, toothed edge.

4. The apparatus recited in claim 1 wherein,
said arcuate blade means is disposed transverse to said elongated perforation means.

5. The apparatus recited in claim 1 wherein,
said anvil means comprises a resilient member which interacts with said blade means.

6. The apparatus recited in claim 1 wherein,
said anvil means is adhered to said second arcuate support means.

7. The apparatus recited in claim 1 wherein,
said second arcuate support means include a groove, and
said anvil means includes a portion thereof which engages said groove.

8. The apparatus recited in claim 1 wherein,
said elongated perforation means includes an elongated blade means.

9. The apparatus recited in claim 1 wherein,
said elongated perforation means includes an elongated anvil for selectively engaging a perforator blade means.

10. The apparatus recited in claim 1 including,
a second cylinder substantially identical with said first mentioned cylinder and having elongated perforation means extending axially along the length thereof, said second cylinder adapted to interest with said first mentioned cylinder in a rolling arrangement.

11. The apparatus recited in claim 10 wherein,
said elongated perforation means of said first mentioned cylinder comprises a blade, and
the elongated perforation means of said second cylinder comprises an anvil which selectively engages said blade when first mentioned said cylinder and said second cylinder rotate relative to each other.

* * * * *